US006840071B2

(12) United States Patent
Sedley

(10) Patent No.: US 6,840,071 B2
(45) Date of Patent: Jan. 11, 2005

(54) MAGNETIC KEY-OPERATED LOCKS

(76) Inventor: Bruce Samuel Sedley, 2817 Milo Hae Loop, Koloa, Kauai, HI (US) 96756

( * ) Notice: Subject to any disclaimer, the term of this patent is extended or adjusted under 35 U.S.C. 154(b) by 0 days.

(21) Appl. No.: 10/443,818

(22) Filed: May 23, 2003

(65) Prior Publication Data

US 2004/0231377 A1 Nov. 25, 2004

(51) Int. Cl.[7] ..... E05B 47/00
(52) U.S. Cl. ..... 70/276; 70/387; 70/413
(58) Field of Search ..... 70/215, 216, 387, 70/389, 390, 429, 276, 413

(56) References Cited

U.S. PATENT DOCUMENTS 3,995,460 A * 12/1976 Sedley ..... 70/210
4,133,194 A * 1/1979 Sedley et al. ..... 70/222
4,918,957 A * 4/1990 Eisermann ..... 70/276
5,291,766 A * 3/1994 Eisermann ..... 70/276
5,655,395 A * 8/1997 Merchel ..... 70/387
5,664,449 A * 9/1997 Sedley ..... 70/276
6,474,121 B2 * 11/2002 Sakai et al. ..... 70/276

FOREIGN PATENT DOCUMENTS

EP 0024242 * 2/1981

* cited by examiner

*Primary Examiner*—Lloyd A. Gall
(74) *Attorney, Agent, or Firm*—Leydig, Voit & Mayer, Ltd.

(57) ABSTRACT

A magnetic card-operated lock has a rotatable exposed cover with a peripheral slot into which a magnetic coded operating card can by inserted for unlocking or locking the lock. The cover and principal locking components are mounted to rotate freely about a central axis between a null position and an unlocking position. A positionable weight is mounted to rotate with the cover plate and is radially separated from the axis so as to bias the cover towards various null positions under the action of gravity. There is also a card lock-in mechanism comprising a card lock-in pin that retains a card in the slot while the lock is unlocked, and a card for said lock with hole and dimple projections to retain it when inserted into the slot.

21 Claims, 4 Drawing Sheets

MAGNETIC KEY-OPERATED LOCKS

FIELD OF THE INVENTION

The invention relates to locks, which are operated by magnetic cards or keys.

Such locks are already known and described for example in European Patents EP 0241323, 0024242, 0498465 and U.S. Pat. No. 3,995,460. The present invention relates to certain modifications to such locks. For example, in U.S. Pat. No. 3,995,460 there is a depicted embodiment with a hole in the card being impaled by a pivoting pin. That pin however impales the card as the card is being inserted and not as the housing is being rotated as is the case in present embodiments to be described in detail herein.

To operate the prior locks, a coded magnetic card or key is inserted in the lock to unlock the lock and allow a door, gate or other barrier to be opened. Typically, the card must remain in the lock during unlocking but can be removed when the lock is unlocked. An externally exposed slot is provided for the card in a periphery of an exposed rotatable or fixed position body. The body may be, or form part of, a door catch release knob or handle that allows the magnetic card to be slidingly inserted. The lock may be free-turning, through about 360 degrees. The card slot may come to rest at a rotational position not convenient for subsequent card insertion. That null position may not be readily adjustable. The slot is preferably positioned uppermost for most convenient card insertion and easy visibility of the slot. However, when the lock is used externally in a building or in the open, for a gate way, an uppermost slot exposes the inside of the lock to rain, external surface water, debris and dirt so a side or bottom slot position is preferable.

In certain applications the magnetic card is held in the lock during unlocking and locking, so it is not necessary to hold the card in place while rotating the lock body; the card being removable by pulling it out of the slot. However, there is sometimes a requirement that the card should not be removed when the lock is unlocked as the lock is not to be left in an unlocked mode. Such facility is not presently provided in locks of this type.

OBJECT OF THE INVENTION

It is an object of the invention to overcome both of these problems.

DISCLOSURE OF THE INVENTION

According to one aspect of the invention there is provided a magnetic card-operated lock comprising a rotatable exposed cover with a peripheral slot into which a magnetic coded operating card can be inserted for unlocking or locking the lock, in which the cover and principal locking components are mounted to rotate freely about a central axis between a null position and an unlocking position, including a weight mounted to rotate with the cover and radially separated from the axis so as to bias the cover towards the null position under the action of gravity.

Preferably the slot can be directed upwardly, downwardly, left or right, or any other orientation by appropriate positioning of the weight with respect thereto.

Preferably the magnetic card-operated lock includes a securing plate, mounted to rotate with the cover, and to which the weight is attached.

Preferably the weight is attachable-releasably to the securing plate.

Preferably the securing plate has a number of attaching means to enable the securing plate to be attached at different chosen radial positions with respect to the cover so as to change the null positions respectively.

Preferably the magnetic card-operated lock includes a card lock-in mechanism for holding a card in the slot whenever the lock is unlocked, in which the lock-in mechanism includes a lock actuator that is moved axially as the lock is unlocked, towards the card inserted in the slot to engage and hold the card in the slot while the lock is unlocked.

In one embodiment the card lock-in mechanism-includes a fixed-position body having a longitudinal passage into which a fixed pin extends into a peripheral spiral groove around a slidable lock actuator with card lock-in pin to cause axial movement of the actuator toward the inserted card as the actuator is rotated within the body due to rotation of the cover.

In another embodiment, the card lock-in mechanism includes a fixed-position body having a longitudinal passage with a peripheral spiral groove and the card lock-in pin includes a radial portion that extends into the peripheral spiral groove to cause axial movement of the card lock-in pin towards the inserted card as the actuator is rotated within the body due to rotation of the cover.

In this embodiment, the card lock-in pin passes through an actuator that is received within the said passage through the fixed position body, the actuator being retained longitudinally within the fixed position body but allowed to rotate.

Preferably a tailpiece driver is located in the longitudinal passage of the fixed position body and engages with the tailpiece actuator.

Preferably there is a lazy cam interaction between the tailpiece actuator and tailpiece driver.

Preferably there is a sleeve fixed within the longitudinal passage of the fixed-position body, the sleeve comprising said spiral groove in the form of a slot cut through the wall of the sleeve.

Preferably the magnetic card-operated lock further comprises an adapter arranged to be fitted to a door latch operating mechanism, and a door latch operating handle that fits to the adapter and houses the lock.

According to another aspect of the invention, there is provided a magnetic card-operated lock comprising a rotatable exposed cover with a peripheral slot into which a magnetic coded operating card can be inserted for unlocking or locking the lock, in which the cover and principal locking components are mounted to rotate about central axis between a null position and an unlocking position, the lock further comprising a card lock-in mechanism for holding a card in the slot whenever the lock is unlocked, in which the lock-in mechanism includes a lock actuator that is moved axially as the lock is unlocked towards the card inserted in the slot to engage and hold the card in the slot while the lock is unlocked.

There is further disclosed herein a magnetically coded card for use with the disclosed locks and comprising at least one dimple projecting therefrom and engaging with the slot upon insertion therein and providing resistance against removal from the slot. Unless the card is held fully into the slot as the housing starts to be rotated, the pin may touch the card at a location other than the hole, it being preferable that the fully-inserted card remain in that position until the card lock-in pin has entered the hole in the card, or the pin could touch the card at a location other than the hole and further pressure could damage the card or the mechanism.

BRIEF DESCRIPTION OF THE DRAWINGS

Preferred forms of the invention will now be described by way of example with reference to the accompanying drawings, wherein.

DESCRIPTION OF THE PREFERRED EMBODIMENTS

Figure 1:
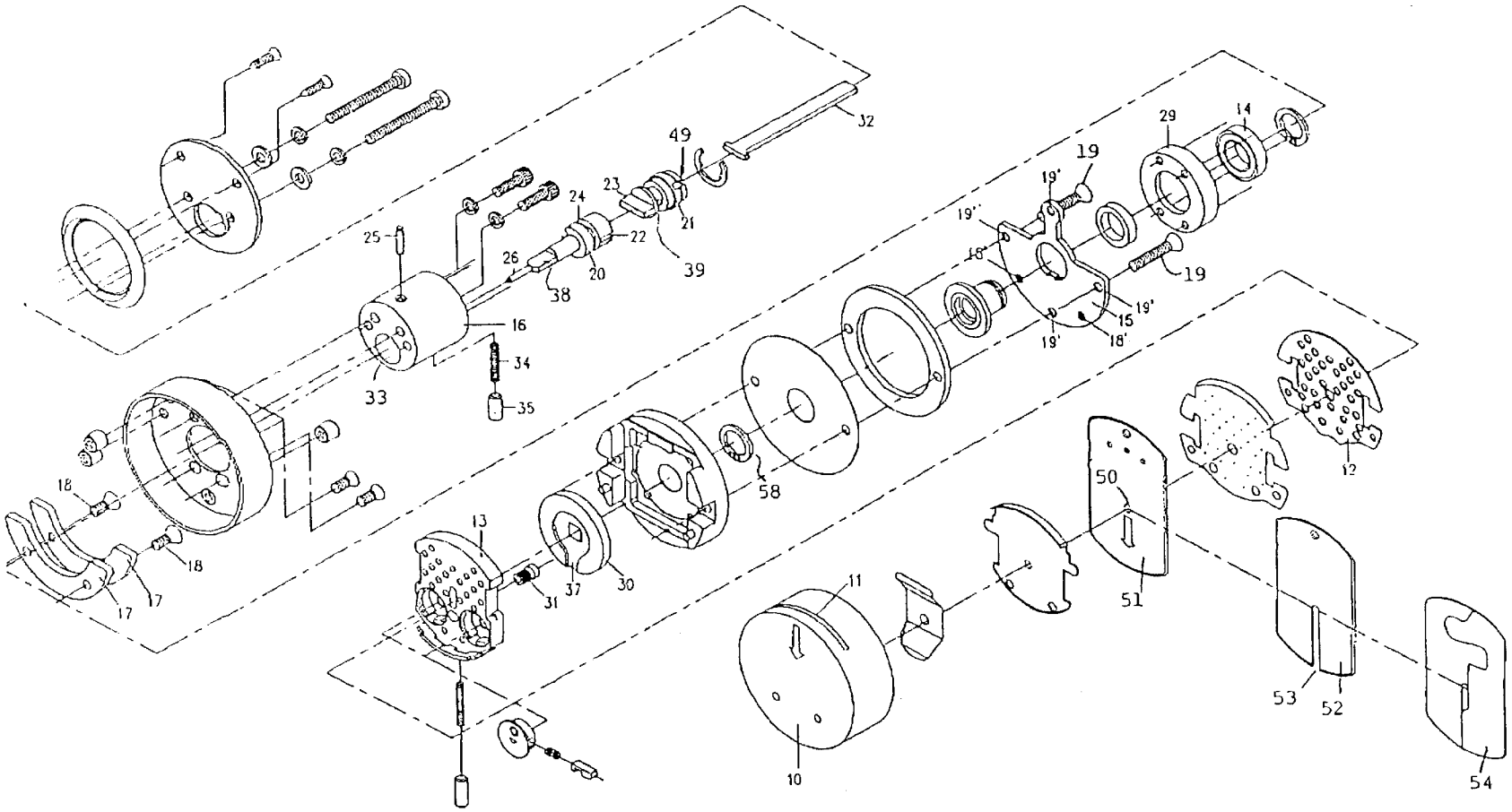
FIG. 1 is a schematic parts-exploded perspective illustration of a magnetic card-operated lock.
Figure 2A:
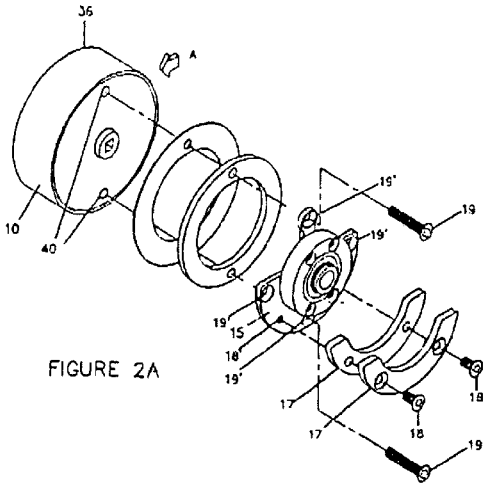
FIG. 2A is a schematic parts-exploded perspective illustration of parts of the locking mechanism showing the configuration of the weights to position the card slot sideways for a left-handed door.
Figure 2B:
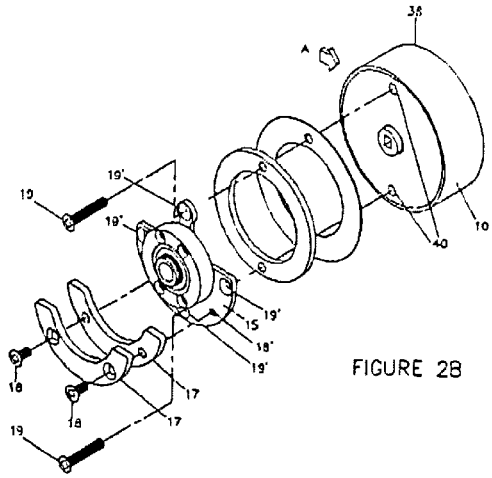
FIG. 2B is a schematic parts-exploded perspective illustration of parts of the locking mechanism showing the configuration of the weights to position the card slot sideways for a right-handed door.
Figure 2C:
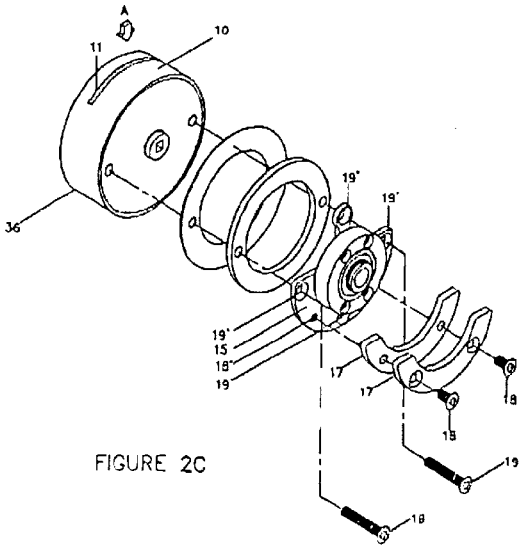
FIG. 2C is a schematic parts-exploded perspective illustration of parts of the locking mechanism showing the configuration of the weights to position the card slot upward for a right-handed door.
Figure 2D:
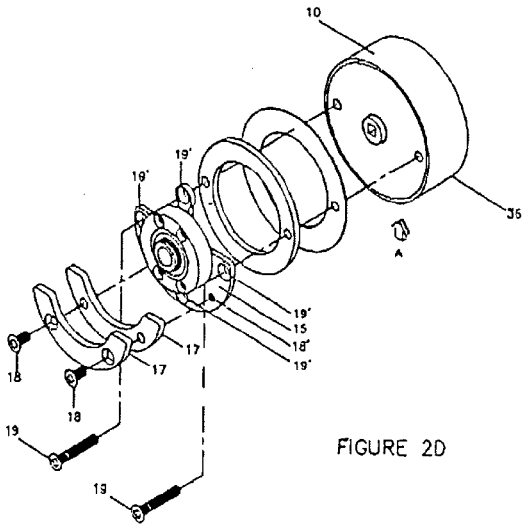
FIG. 2D is a schematic parts-exploded perspective illustration of parts of the locking mechanism showing the configuration of the weights to position the card slot downward for a right-handed door.

Referring to the drawings, in FIG. 1 various components of the lock are shown which are not directly relevant to the present invention and so will not be specially mentioned in the description. More relevant, the lock has a cover 10 with a peripheral slot 11 for receiving a magnetic card 51. The cover 10 and principal components of the lock, including a lock plate 12 and a magnet pin tumbler carrying lock core 13, are mounted on a friction free bearing 14 to rotate, together with a securing plate 15, about a common fixed central axis of the lock and a bearing bushing 29. In order to operate the lock, a correctly magnetically coded card 51 is inserted in the slot 11 and then the cover 10 (and internal mechanism) is rotated through the arc, typically 90° or more, in a manner already well-known. At the same time, a card tailpiece actuator 20 is engaged and is also rotated. It functions in a manner to be described more fully below.

A null rotational position for the free-turning cover 10 is determined by two semi-circular weights 17 that are fixed by screws 18 to the securing plate 15 in holes 18'. In the FIGS. 1 and 2C the null position of the cover 10 is arranged so that the slot 11 is uppermost. However, the securing plate 15 is provided with four screw holes 19' (FIG. 2) so as to be secured in any one of four rotational positions. Thus, the slot 11 can be set to come to rest due to the gravitational force on the weights either at the top as shown, or facing to the left (FIG. 2A), to the right (FIG. 2B) or downwards (FIG. 2D) according to the position of the weights relative to the lock housing 36 (FIG. 2). Thus, as pictured, four null positions for the slot 11 can be chosen. In each case the lock is operated in the same manner as before, that is by inserting a correctly coded magnetic card into the slot 11 to "unlock" the lock, and rotating the cover 10 from the null position. When the card is removed the weights return the slot to the null position. It will be appreciated that it is a simple matter to change the position of the weights at any time if a different null position is required.

The described lock can also include a card lock-in mechanism (FIG. 1), that includes a fixed body 16, the lock actuator 20 and a tail piece driver 21 that operates a connected lock set (not shown) to extend and retract a latch and/or bolt so that a door can be opened or secured. The actuator 20 and the tailpiece driver 21 are mechanically coupled by a slot 22 in the rear face of the actuator that receives a flat finger 23 extending from the front face of the tailpiece driver 21. Mechanical coupling between the slot 22 and the finger 23 is maintained effective even when the actuator moves a limited distance axially away from or towards the tailpiece driver. Both components 20 and 21 are contained within 1 through-hole 33 in the body 16.

The actuator 20 has a peripheral spiral groove 24 into which a remote end of a fixed pin 25 in body 16 is located. The pin extends into the hole 33 to engage in the groove 24. As a result, turning the cover 10 with a correctly coded card inserted and the tumbler carrying core 13 depressed, a driver pin 31 in the rear surface of core 13 engages a notch 37 in disc 30 which in turn rotates a flat portion 38 of the actuator 20 inserted into the axis slot of the disc 30. This rotates the actuator 20 to move-axially through the body 16 towards the card slot 11 due to the fixed pin 25 in spiral groove 24. A pointed finger 26 on the front of the actuator 20 enters and extends through a hole 50 provided in the inserted card 51 and thereafter prevents the card being pulled out of the slot 11 as the lock is unlocked. The card cannot be removed until the lock is again locked when the above action is reversed. That is, the card and slot is rotated in the opposite direction-retracting the finger 26 from the centre hole 50 in the inserted card 51. Then the actuator 20 is moved, by relative rotation of the groove 24 and the fixed pin 25, towards the tailpiece driver 21.

The slot 22 of tailpiece actuator 20 is axially movable over the flat finger 23 of the tailpiece driver 21. The formed end of the tailpiece 32 is received within a slot 49 in the rear surface of the driver 21. The tailpiece 32 can be provided with a number of transverse lines of weakness (not shown) enabling the tailpiece to be snapped into the required length by the lock installer to fit doors of various thickness. The tailpiece 32 rotates upon rotation of the driver 20 to thereby operate a lock (not shown) into which it extends.

There is a spring 34 and plunger 35 fitted within the body 16 that serves to prevent inadvertent rotational movement of the tailpiece 32 by the end of the plunger 35 pressing on a flat area of groove 39 around the circumference of tailpiece driver 21. This feature prevents inadvertent locking or unlocking of the connected lock-mechanism that might occur prematurely should the tailpiece 32 be allowed to rotate freely.

Should it be desirable to provide means to leave the lock in the unlocked mode, a coded unlocking card 52 is used. Such an unlocking card is formed with an open slot 53, extending from a bottom edge of the card to and including the area of the central hole 50 in the card, to straddle the extended finger 26. Such an unlocking card may be used to unlock the lock and then be removed in the unlocked position because the open slot 53 allows the card to be withdrawn from the slot 11 with the finger 26 extended, leaving the lock in the unlocked mode. The unlocking card must also be used for locking the lock if it has been left unlocked, because a normal card cannot be fully inserted in the slot 11 due to the extended finger 26. In this case the cover 10 must first be rotated to the position of the card slot when the card was removed, then the unlocking card 52 can be inserted and the mechanism operated and the lock housing 36 rotated back to the locked mode where the finger 26 is retracted out of the slot 53 in the card. Then the unlocking card is removed.

The above described unlocking card as well as a second embodiment of the unlocking card is shown in the applicant's European Patent EP 0024242. A two-piece card 54 is inserted into the-unlocked lock seriatim when the finger 26 is extended across card slot 11 then the two pieces are fitted together in the slot 11. When both sides are joined around the finger 26, the lock can be actuated and the housing 36 rotated back to the locked mode where the finger 26 is retracted from slot 11 and the card can be removed in one piece.

FIGS. 2A to 2D illustrate how the cylinder code module 36 (comprising parts 10, 11 etc) can be biased into a selected orientation by choice of attachment positions of the weighted securing plate 15. Arrow A in each of the figures indicates the insertion direction of the magnetically coded card into the cylinder code module. That is, the card-insertion slot 11 can face upwardly, downwardly, left or right, or any angle in between. The two pre-tapped holes 40 in the cylinder code module cover 10 receive screws 19 by which the securing plate 15 is mounted thereto. The weights 17 attached to the securing plate 15 will bias the card-insertion slot 11 into the desired null-orientation by gravity. Four of such positions are depicted.

Figure 3:
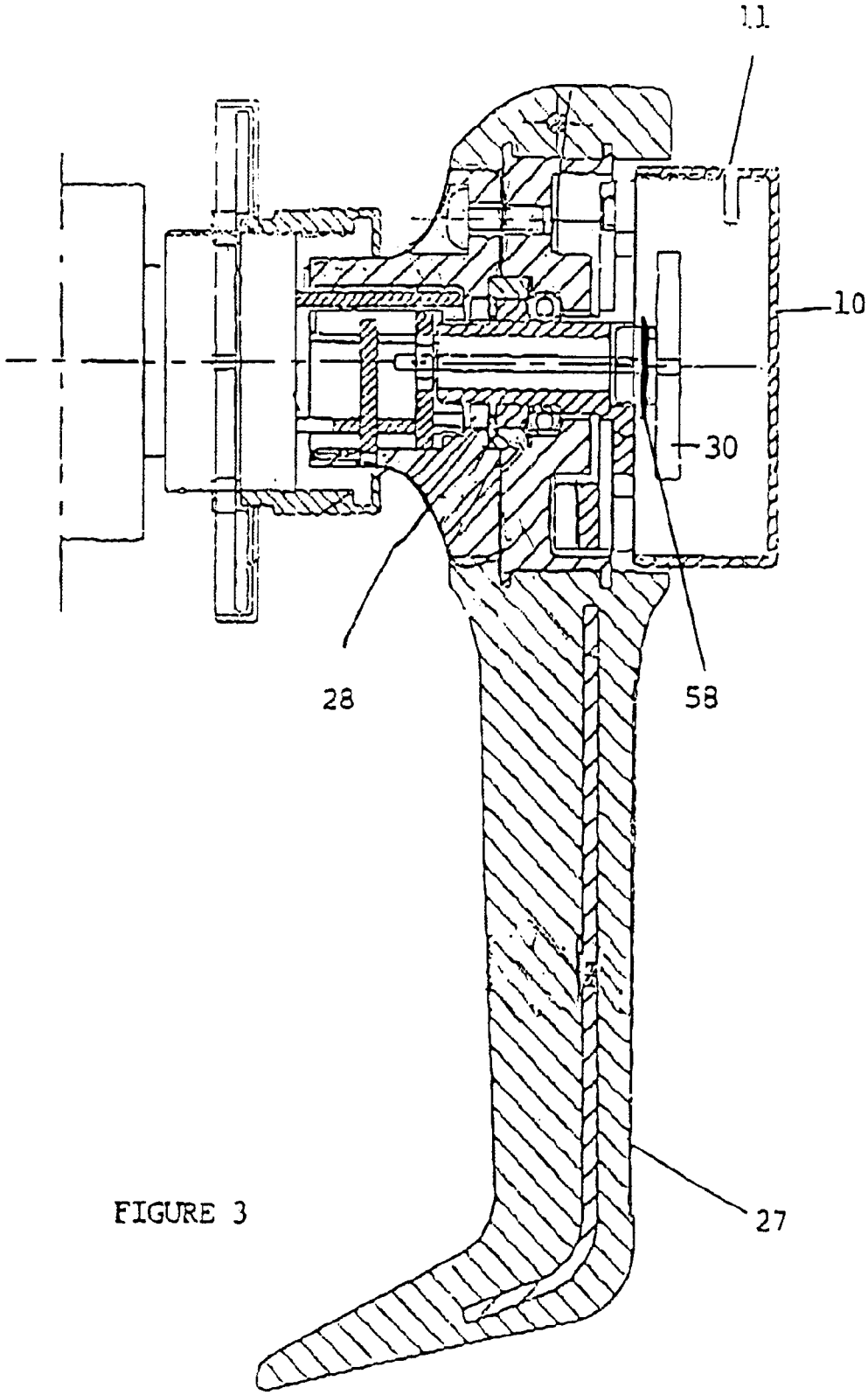
FIG. 3 is a schematic cross-sectional view of a door handle incorporating a similar magnetic card-operated weighted card slot lock.

In FIG. 3, a lock similar to the lock of FIGS. 2A–2D is mounted in a cylindrical lock door operating handle 27 having the rotatable cover 10 and slot 11 as before. The cover is oriented to a chosen position by weights in the manner described above. An important feature of the arrangement of FIG. 3 is a central lock spindle adapter 28 that can be provided to fit different lock spindle dimensions. This enables the same handle 27 to be used with different lock mechanisms or for such handles already installed on locks to be replaced with a magnetic card-operated lock/handle. It is particularly important that the slot 11 can be set to any desired rotational null positioning by selective positioning of the weights 17. As a result, the lock can be provided with a keyed handle mounted on a left side or a right side of a door, and either inside or outside the door. In all positions the slot 11, can be automatically positioned as desired due to the selective positioning of the securing plate 15 with weights 17. If slot 11 is positioned either up or down no change is required for either left or right hand mounting as the slot remains in the desired position due to gravity when the handle points either right or left. For mounting with slot to either side, relocation of the securing plate with its attached weights is required. Such a handle lock can-also contain a similar card Lock-in Mechanism as previously described.

Figures 4, 5:
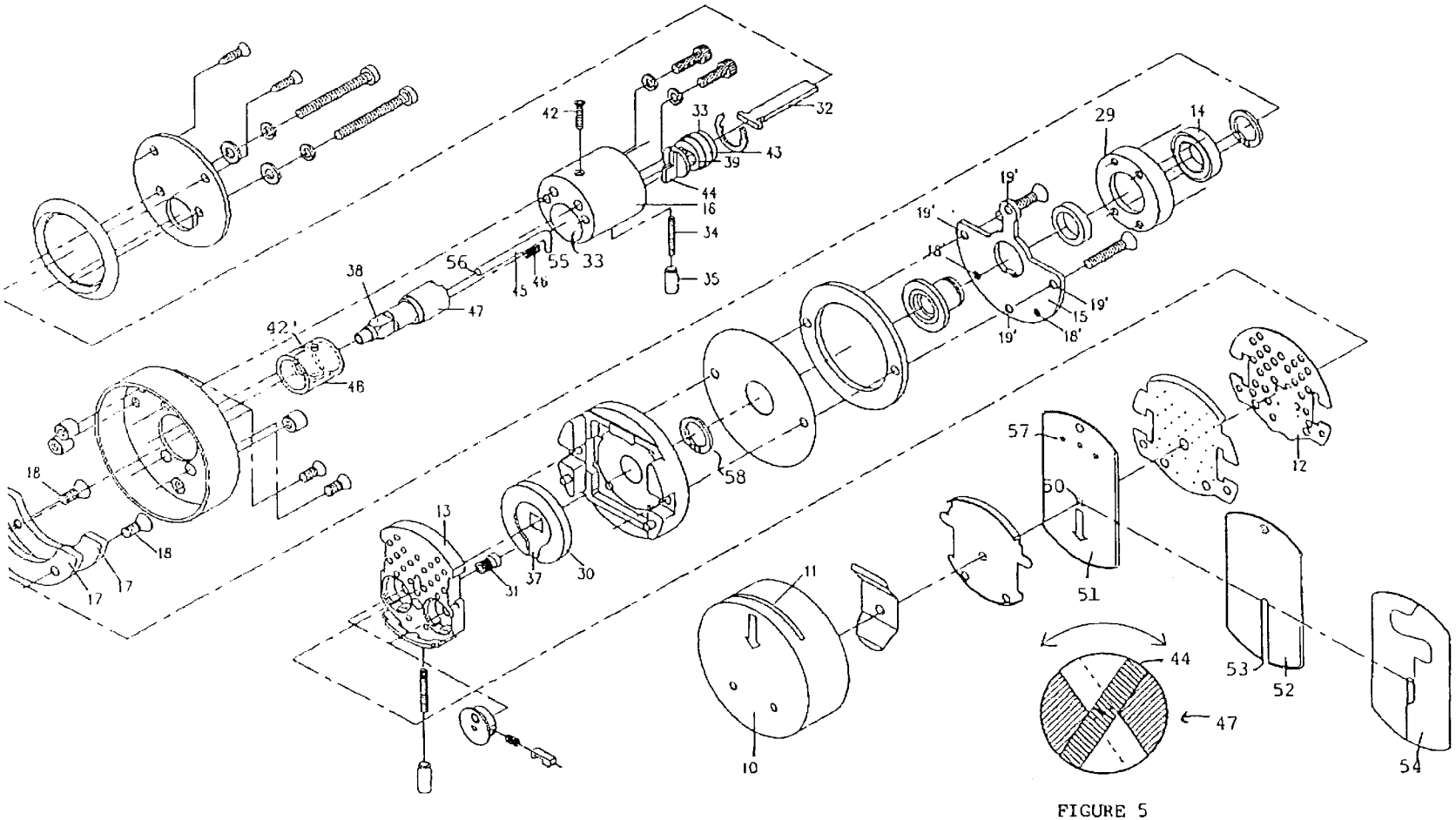
FIG. 4 is a schematic parts-exploded perspective illustration of one embodiment of a magnetic card-operated lock.
FIG. 5 is a schematic end elevational view of the tailpiece engagement parts of the lock of FIG. 4.

In FIGS. 4 and 5 of the accompanying drawings there is depicted schematically an improved card-lock-in device. In this alternative embodiment, the tip end 56 of the card lock-in pin 45 enters the hole 50 in the inserted card 51 before the lock mechanism begins to unlock the attached lock. This is achieved by moving only the card lock-in pin through the hole in the card at the start of rotation of housing assembly 36. The other components remain aligned in the body of the lock.

The card-lock-in pin 45 is L-shaped with its short rear end extending 90° radially. The longer part of the card lock-in pin 45 extends through actuator 47 that in turn is positioned for rotation in sleeve 48. The tailpiece actuator 47 and sleeve 48 are fitted within the longitudinal hole 33 through body 16. Rather than milling a spiral groove into the surface of the tailpiece actuator as in the embodiment of FIG. 1, there is a spiral slot cut through the wall of the sleeve 48. The tailpiece actuator 47 extends through the sleeve 48. The arc of the spiral slot in sleeve 48 only extends around half its circumference and this provides a more positive card lock-in pin movement. There is a spring 34 and plunger 35 that rides in the groove 39 of the tailpiece driver 43 as is the case with the embodiment of FIG. 1, serving to hold it in place and also to provide a detent flat surface to bias the tailpiece actuator to the "locked" position which is the starting point of rotation. There is a retention screw 42 passing radially through the body 16 to secure the sleeve 48 in place through hole 42'.

The tailpiece actuator 47 is slotted on one end with another slot on its side (not shown) to receive a spring 46 and the 90° bent over short end of card lock-in pin 45. There is an axial hole through the tailpiece actuator into which the longitudinal part of card lock-in pin 45 extends such that its tip 56 may pass through the hole 50 in magnetic card 51. As the card lock-in pin 45 moves forward such that its tip extends beyond the leading end of tailpiece actuator 38, the 90° bent over end of card lock-in pin 45 compresses the spring 46. That is, the spring urges the card lock-in pin 45 back to the starting position when the lock has returned to the locked mode.

The tailpiece driver 43 has an off-centre finger 44 extending from its front face. As shown in FIG. 5, the back end of the tailpiece actuator 47 has an hourglass shaped slot into which the finger 44 extends. The 90° bent end of the card lock-in pin 45 is also received in this slot. It should be noted that as a result of the configuration of FIG. 5, the tailpiece actuator 47 can rotate before contacting the finger 44 to begin rotation of the tailpiece driver 43 which unlocks the lock, this is termed "lazy cam" action. It allows the tip end 56 of the card lock-in pin 45 to enter hole 50 in card 51 to prevent its removal from card slot 11 as described in detail below.

The driver pin of the magnet-carrying core is normally positioned in the lower central area of the driver disc 30. When a correct card is inserted into the code module it moves the magnet-carrying core 13 of the module downwards. The driver pin 31 in the rear of that core moves down into the open slot 37 of the driver disc 30. Subsequent rotation of the code module 36 and core rotates the driver pin 31 which in turn rotates the driver disc 30. The square hole in the disc receives the square portion 38 of the tailpiece actuator so it also is rotated. As the tailpiece actuator 47 carries the bent card lock-in pin 45, the rotation causes the tip 55 of the pin to ride up the spiral slot in the sleeve 48 moving the pin forward into the card slot where it impales the card 51 through hole 50, preventing its removal. A circlip 58 prevents disc 30 from moving axially into contact with the rear surface of the magnet pin-carrying core 13, which could jam the mechanism.

Reversing the rotation of the code module retracts the card lock-in pin 45 out of the hole 50 in the card and when fully retracted in the "locked" mode of the lock-in device, the card can be removed from the code module slot.

Although the card 51 is retained in the housing 36 as it is rotated, it is desirable to be able to release pressure on the inserted card when the housing is first rotated.

To accomplish this the card 50 has stamped dimples 57 in its surface so that the initial pressure to insert the card will push the dimples fully into the slot 11 of cover 10 and hold the card in the fully inserted position as the housing is rotated. The dimples are pressed past the cover thickness at the card slot so they grip on the inside surface edge of the cover to offer resistance to the removal of the card.

It should be appreciated that modifications and alterations obvious to those skilled in the art are not to be considered as beyond the scope of the present invention.

What is claimed is:

1. A magnetic card-operated lock comprising a rotatable exposed cover with a peripheral slot into which a magnetic coded operating card can be inserted for unlocking or locking the lock, in which the cover and principal locking components are mounted to rotate freely about a central axis between a null position and an unlocking position, including a weight mounted to rotate with the cover and radially spaced from the axis so as to bias the cover towards the null position by the action of gravity.

2. The magnetic card-operated lock of claim 1 wherein the slot can be directed upwardly, downwardly, left or right, or any other orientation by appropriate positioning of the weight with respect thereto.

3. The magnetic card-operated lock according to claim 1, including a securing plate, mounted to rotate with the cover and to which the weight is attached.

4. The magnetic card-operated lock according to claim 3, in which the weight is attachable releasably to the securing plate.

5. The magnetic card-operated lock according to claim 4, in which the securing plate has a number of attaching means to enable the securing plate to be attached at different chosen radial positions with respect to the card slot so as to change the null positions respectively.

6. The magnetic card-operated lock according to claim 1, including a card lock-in mechanism for holding a card in the slot whenever the lock is unlocked, in which the lock-in mechanism includes a lock actuator that is moved axially as the lock is unlocked towards the card inserted in the slot to engage and hold the card in the slot while the lock is unlocked.

7. The magnetic card-operated lock according to claim 6, in which the lock-in mechanism includes a fixed position body having a longitudinal passage into which a pin extends radially into a peripheral spiral groove around a slidable lock actuator to cause axial movement of the actuator as the actuator is rotated within the body due to rotation of the cover.

8. The magnetic card-operated lock according to claim 1, further comprising an adapter arranged to be fitted to a door unlocking mechanism, and a handle that fits to the adapter and houses the lock.

9. The magnetic card-operated lock of claim 8 wherein the adapter is a central lock spindle adapter configured to fit spindle dimensions of different lock mechanisms or for handles already installed on locks to be replaced with a magnetic card-operated lock/handle.

10. The magnetic card-operated lock of claim 8 wherein the card-insertion slot can be set to any desired rotational null positioning by selective positioning of the weight.

11. The magnetic card-operated lock of claim 8 wherein the handle comprises a weighted slot that needs no change in weight position if the handle points left or right.

12. A magnetic card-operated lock comprising a rotatable exposed cover with a peripheral card slot into which a magnetic coded operating card can be inserted for unlocking or locking the lock, in which the cover and principal locking components are mounted to rotate about a central axis between a null position and an unlocking position, the lock further comprising a card lock-in mechanism for holding a card in the slot whenever the lock is unlocked, in which the lock-in mechanism includes a card lock-in pin that is moved axially towards the card inserted in the slot as the lock is unlocked to engage and hold the card in the slot while the lock is unlocked.

13. The magnetic card-operated lock as claimed in claim 12 wherein the lock-in mechanism includes a fixed-position body having a longitudinal passage through which a radial pin-extends into a peripheral spiral groove around a slidable lock actuator to cause axial movement of the actuator as the actuator is rotated within the body due to rotation of the cover.

14. The magnetic card-operated lock as claimed in claim 12 wherein the lock-in mechanism includes a fixed-position body having a longitudinal passage with a spiral groove and the card lock-in pin includes a radial portion that extends into the peripheral spiral groove to cause axial movement of the card lock-in pin as a tailpiece actuator is rotated within the body due to rotation of the cover.

15. The magnetic card-operated lock as claimed in claim 14 wherein the card lock-in pin passes through the tailpiece actuator that is received within the fixed position body, the actuator being retained longitudinally within the fixed position body but allowed to rotate.

16. The magnetic card-operated lock as claimed in claim 15 further comprising a tailpiece driver located in the longitudinal passage of the fixed position body and engaging with the tailpiece actuator.

17. The magnetic card-operated lock as claimed in claim 16 wherein there is a lazy cam interaction between the tailpiece actuator and tailpiece driver.

18. The magnetic card-operated lock as claimed in claim 15 comprising a sleeve fixed within the fixed-position body, the sleeve comprising said spiral groove.

19. The magnetic card-operated lock according to claim 12, further comprising an adapter arranged to be fitted to a door unlocking mechanism, and a handle that fits to the adapter and houses the lock.

20. The magnetic card-operated lock of claim 19 wherein the adapter is a central lock spindle adapter configured to fit spindle dimensions of different lock mechanisms or for handles already installed on locks to be replaced with a magnetic card-operated lock/handle.

21. The magnetic card-operated lock of claim 13 wherein the card-insertion slot can be set to any desired rotational null positioning by selective positioning of the a weight.

* * * * *